US005339747A

United States Patent [19]

Epps

[11] Patent Number: 5,339,747

[45] Date of Patent: Aug. 23, 1994

[54] DETACHABLY INTERCONNECTED WORK TABLES USING PANEL SECTIONS OF VARIOUS GEOMETRIC SHAPES

[76] Inventor: Alan L. Epps, P.O. Box 226, Chelsea, Quebec, Canada, J0X 1N0

[21] Appl. No.: 919,230

[22] Filed: Jul. 27, 1992

[51] Int. Cl.[5] ..... A47B 57/00

[52] U.S. Cl. ..... 108/64; 248/188.8

[58] Field of Search ..... 108/63, 59, 64, 111, 108/114, 185; 312/107, 107.5, 111; 248/188, 188.8, 432, 440; 211/187, 207

[56] References Cited

U.S. PATENT DOCUMENTS

| | | | |
|---|---|---|---|
| 2,602,012 | 7/1952 | Doty | 108/62 |
| 3,053,598 | 9/1962 | Cheslow | 108/64 |
| 3,367,291 | 2/1968 | Evans | 108/64 |
| 3,741,852 | 6/1973 | Keener | 108/64 X |
| 4,731,918 | 3/1988 | Burghardt | 108/156 X |
| 4,732,088 | 3/1988 | Koechlin et al. | 108/114 X |
| 4,941,412 | 7/1990 | Engel | 108/156 |
| 4,986,194 | 1/1991 | Bollman | 108/111 |
| 5,002,247 | 3/1991 | Dispenza | 248/188 |

FOREIGN PATENT DOCUMENTS

| | | | |
|---|---|---|---|
| 2228451 | 2/1975 | France | 108/64 |
| 0675816 | 11/1990 | Switzerland | 108/64 |

*Primary Examiner*—Clifford D. Crowder
*Assistant Examiner*—Ismael Izaguirre
*Attorney, Agent, or Firm*—Stanley E. Johnson

[57] ABSTRACT

A free standing modular office furniture system that includes geometrically shaped panels each of which is right angular, and has a minimum of three corners that are either 90°, 45°, or 135°, a right angle triangular leg assembly and connecting plates. Selected corners of the panels have a recess that is a right angle isosceles triangle that receives a plate which is connected to the leg by a bolt extending through the leg. The leg is a two-part aluminum extrusion and selected plates have two, three or four times the surface area of a recess and fit into that many recesses which also corresponds to the number of panels in abutting edge relation. The selected plates overlap the panels joining the same together as they are clampingly engaged between such plate and the leg associated therewith.

24 Claims, 5 Drawing Sheets

DETACHABLY INTERCONNECTED WORK TABLES USING PANEL SECTIONS OF VARIOUS GEOMETRIC SHAPES

FIELD OF THE INVENTION

This invention relates to work tables particularly for office, laboratory and workshop use which may be variously configured to fit the user's requirement and more particularly to various geometrically shaped work tables mounted on supporting elements which serve also to detachably interconnect the work tables.

BACKGROUND OF THE INVENTION

A modular work table is disclosed in U.S. Pat. No. 4,941,412 issued Jul. 17, 1990 to H. S. Engel which discloses table tops with corners removed and attached to triangular shape supports. These supports extend if desired upwardly beyond the table supporting surface.

In G. E. Doty U.S. Pat. No. 2,602,012 issued Jul. 1, 1952 there is illustrated a table construction where the tops are reversible and have legs that attach to the table by plates recessed into the table surface. The plates for connecting the legs to the table top may be square, rectangular, circular or the like.

An object of the present invention is to provide various geometrically shaped work table panels, table legs and connecting plates inter-related with one another so that the panels can be detachably interconnected one to another, in various arrangements as desired, in abutting relation by the legs and plates where the plates overlap adjoining panels and are detachably connected to the legs.

SUMMARY OF THE INVENTION

In keeping with the foregoing there is provided in accordance with the present invention a table assembly comprising:

(a) a plurality of support legs;

(b) at least two right angular panel sections each having at least three corners, planar upper and lower main panel faces and panel edge sidewalls the latter of which intersect at 45°, 90° or 135° corners;

(c) recesses in at least said upper faces which extend inwardly from selected ones of said 90° corners, each recess being in the shape of a right angled isosceles triangle; and (d) means to join said panel sections together with selected sidewalls thereof in abutting relation and the upper panel faces aligned so as to provide a continuous table top surface extending from one said panel section to the other, said joining means comprising flat connector plates in each of the recesses and in adjacent adjoining recesses of abutting panel sections, each said connector plate corresponding in shape to the recess associated therewith overlapping abutting panels having adjoining recesses and means connecting a support leg to a respective one of said connector plates clamping the panels associated therewith therebetween.

LIST OF DRAWINGS

The invention is illustrated by way of example in the accompanying drawings wherein.

Figure 1:
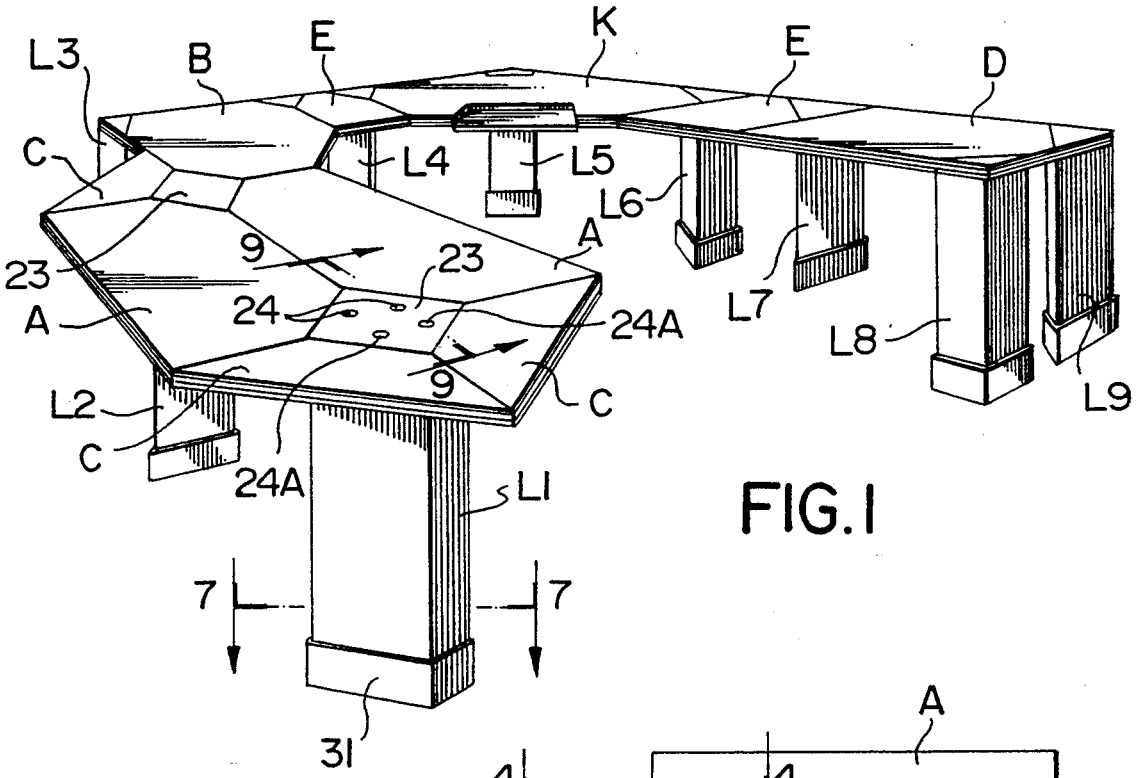
FIG. 1 is an oblique view of a table with a top work surface and assembled from various geometrically shaped panels mounted on legs attached by connecting plates serving also to detachably interconnect one panel to the next.
Figure 6C:
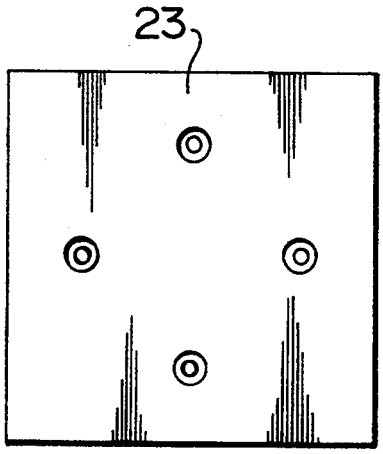
Figure 6A:
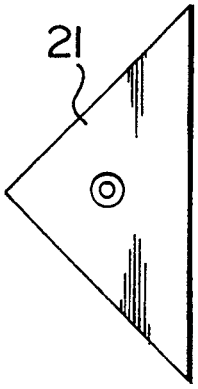
Figure 6B:
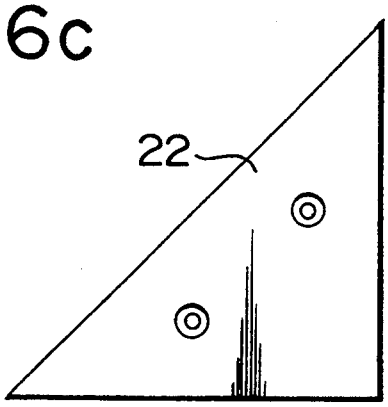
Figure 7:
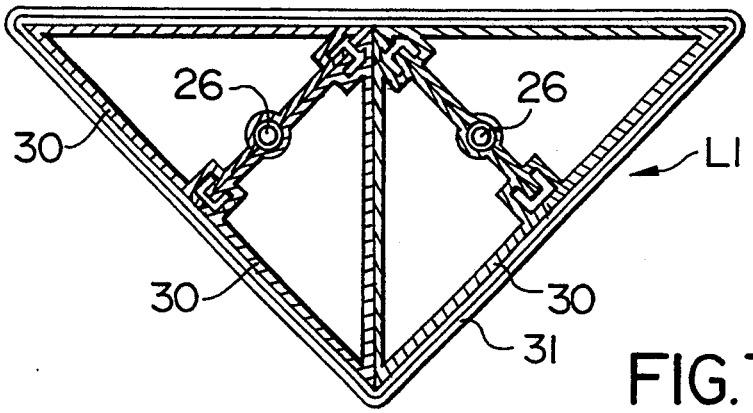
Figure 8:
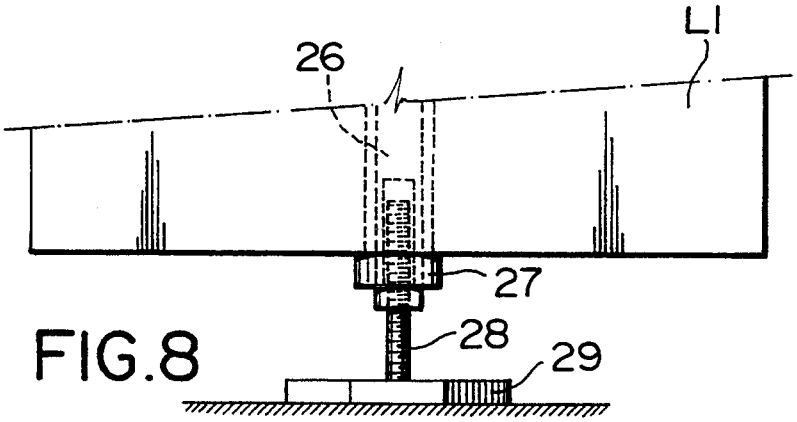
Figure 9:
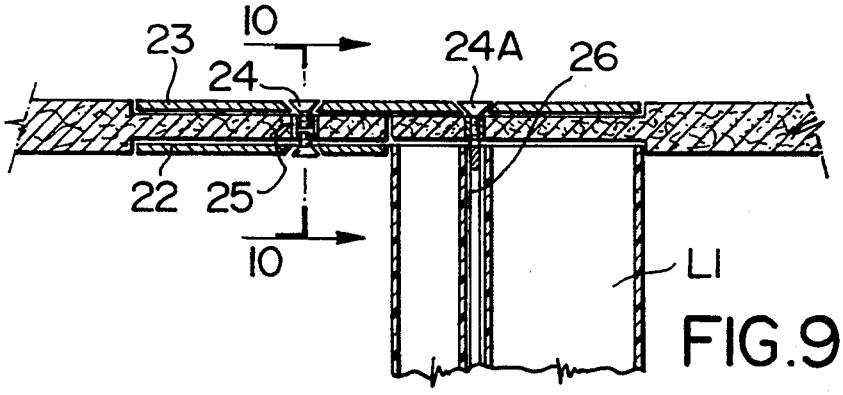
Figure 10:
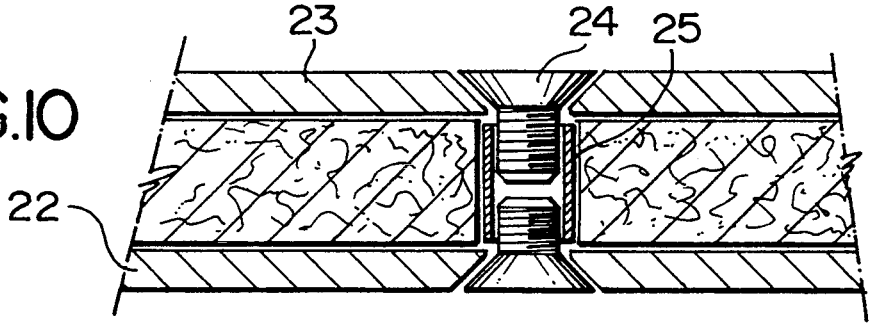
Figure 11:
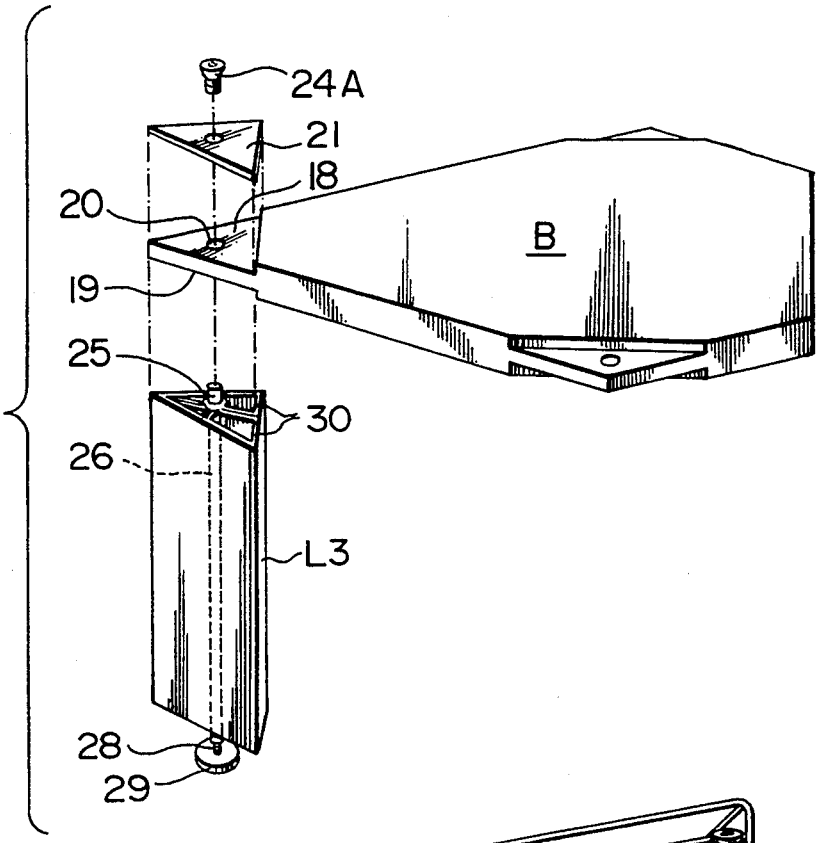
Figure 12:
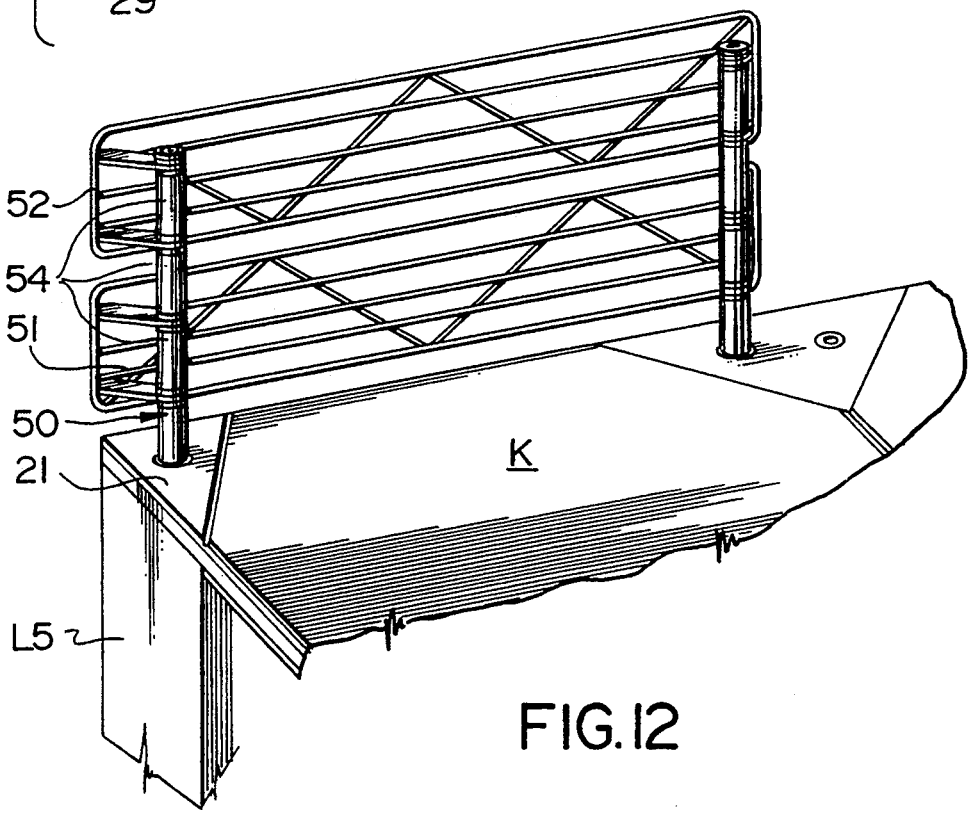
Figure 13:
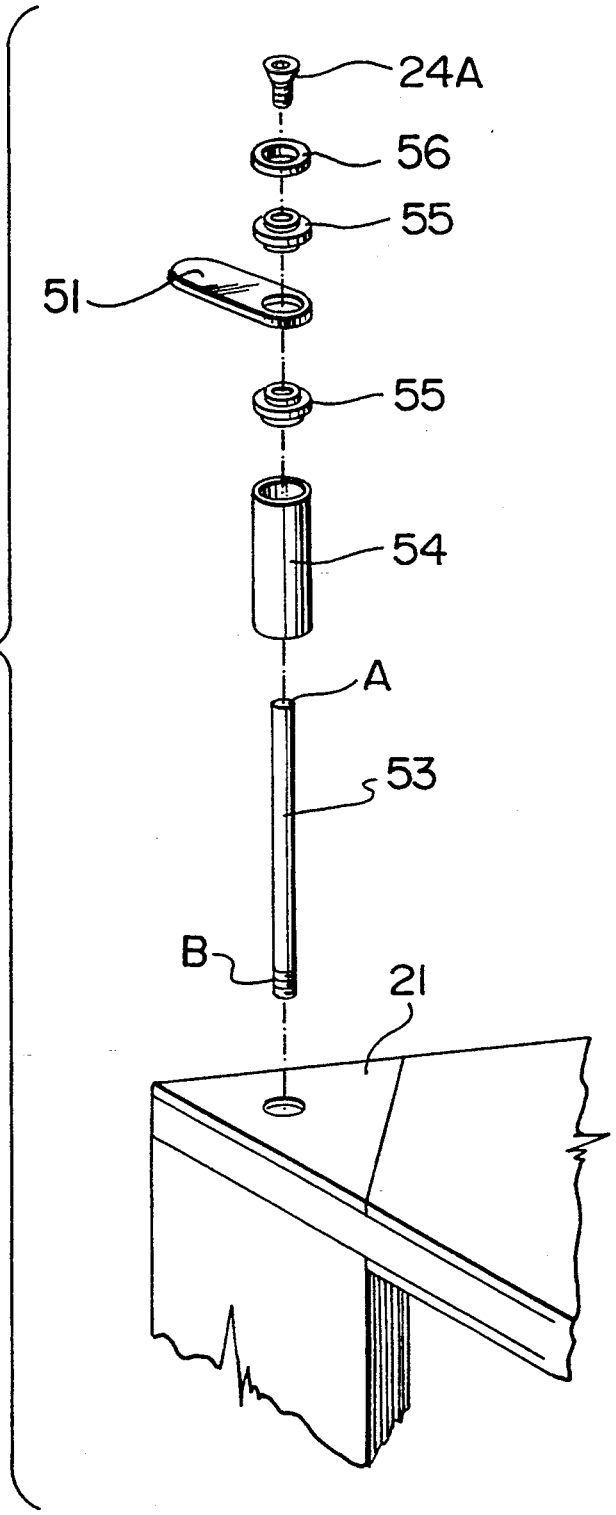

FIG. 6 in views (A), (B) and (C) illustrate variously shaped connector plates for use in clamping the work table panels to the legs;

FIG. 7 is a cross-sectional view taken along line 7—7 of FIG. 1;

FIG. 8 is a partial elevational view of the bottom end of the leg with the bottom skirting removed;

FIG. 9 is a partial sectional, partial elevational view, essentially along line 9-9 of FIG. 1, of the upper end of the leg illustrating its attachment to two adjoining panels providing the work surface;

FIG. 10 is a sectional view, on a larger scale, along line 10—10 of FIG. 9;

FIG. 11 is an exploded isometric view of a single leg at a corner of one of the panels;

FIG. 12 is a partial oblique view illustrating mounting accessories on the table; and FIG. 13 is an exploded view of a post that secures to a leg and extends upwardly from the table for mounting barrier panels.

DESCRIPTION OF PREFERRED EMBODIMENTS

Referring to the drawings FIG. 1 is an oblique view of a series of joined together panel sections of various geometric configurations supported by a plurality of legs. The system is free standing, modular and may be arranged in various configurations using a number of different selected panel shapes, right angle triangular leg assemblies and connector plates. An edge trim piece is attached to at least selected if not all of the edges of all of the panels and allows the use of a flush bracket to tie the various panel sections together ensuring structural rigidity. The panel sections (table tops) are designed so as to be flipped over and thereby provide both left and right handed configurations.

The leg assembly is fabricated from a minimum of two aluminum triangular in cross-section extrusions, connected by clips, and there is a metal rod (or tube) running through the leg which anchors to a top connector plate. The connector plate fits into a recess and overlaps adjacently disposed corners of abutting panel sections. A threaded sleeve fits into a hole in the panel and threaded thereinto is a bolt that extends through the top connecting plate. A metal rod (or tube) that extends through the leg threads into the bottom end of the sleeve providing a mechanical connection. Such rod is anchored to the leg for example by way of a lock nut at the bottom end of the leg. An adjustable foot assembly or levelling glide is mounted on the bottom end of the rod.

Referring particularly to the drawings, FIG. 1 illustrates six differently shaped table top panel sections designated respectively A, B, C, D, E and K. The number of the different geometrically configured panels are in abutting edge to edge relation. The table top panel sections are supported by a plurality of legs designated L1, L2, L3, L4, L5, L6, L7, L8 and L9 which can be seen in the drawing. The legs can be arranged as may be desired and they are connected to plates that fit into recesses on the top surface of the table.

Figure 2:
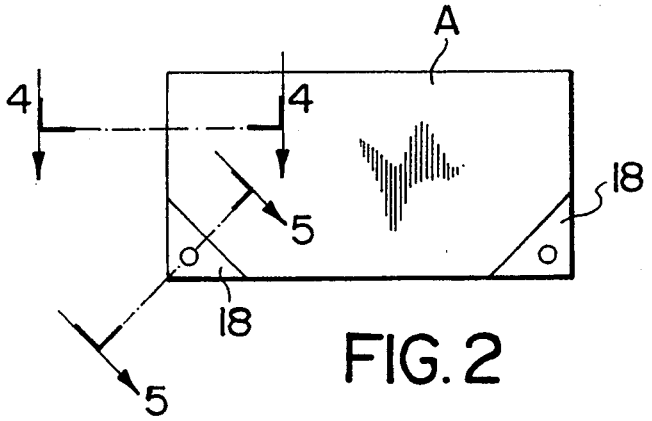
FIG. 2 is a top plan view of one geometrically shaped panel of the panels illustrated in FIG. 1.
Figure 3:
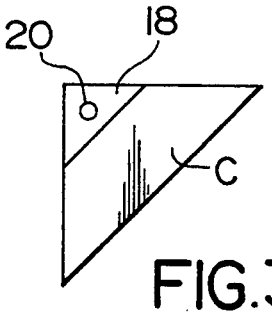
FIG. 3 is a top plan view of another geometrically shaped panel illustrated in FIG. 1.
Figure 3A:
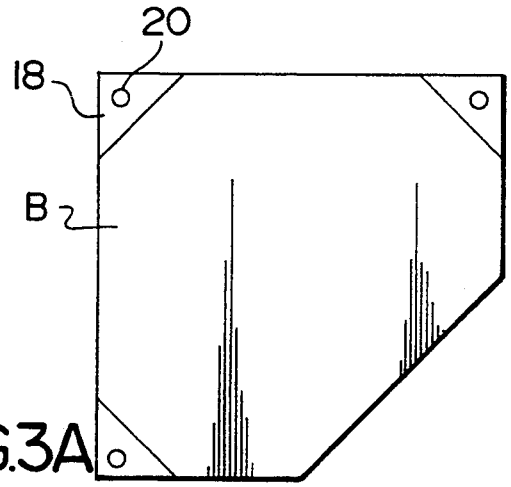
FIG. 3A is a top plan view of a still further panel illustrated in FIG. 1.

Each table top panel section is three, four or five sided with all corner angles being either 45°, 90° or 135° and with at least one corner angle being 90°. FIGS. 2, 3 and 3A are top plan views of the respective table top panel sections designated A, C and B in FIG. 1. Each panel is right angular and selected right angle corners have right angular triangular recesses 18 for receiving a connector plate.

Figure 4:
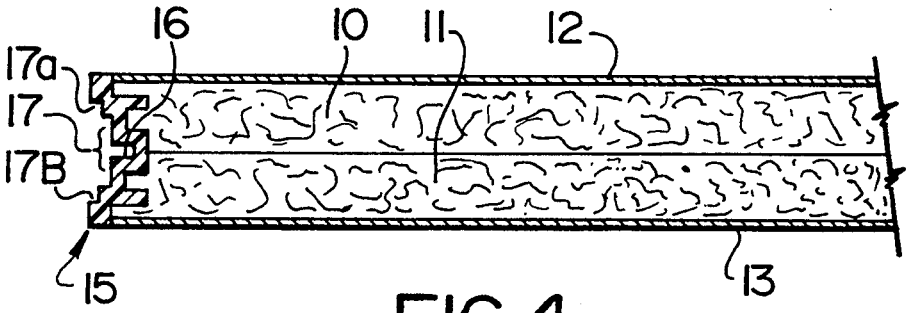
FIG. 4 is a part sectional view taken along line 4—4 of FIG. 2.

The table top panel sections are for example two bonded together layers 10 and 11 (see FIG. 4) of high density fiber board with laminated top and bottom faces designated respectively 12 and 13. Each edge of each panel is trimmed with an edging piece 15 attached as by gluing, compression and/or screws. The edging piece 15 may be wood or an extruded piece of metal or plastics material. Illustrated in FIG. 4 is an extruded plastics material edging piece 15 which has a central narrow channel 16 within and at the bottom of a wider channel 17. There is a stepped shoulder at each of respective opposite sides of the channel 17 that are designated respectively 17A and 17B. Adjoining panel sections can be bridged by a strip of metal, plastic or the like, that matingly fits into channel 17 and fastened by metal self-tapping screws that thread into the bite of channel 16. A concealing or cover strip (not shown) of metal, wood, plastic or the like abuts shoulders 17A and 17B and is fastened in any convenient manner (i.e. gluing, clips etc.) hiding from view the panel edge connecting means and provides a decorative outer edge that can readily be changed.

Figure 5:
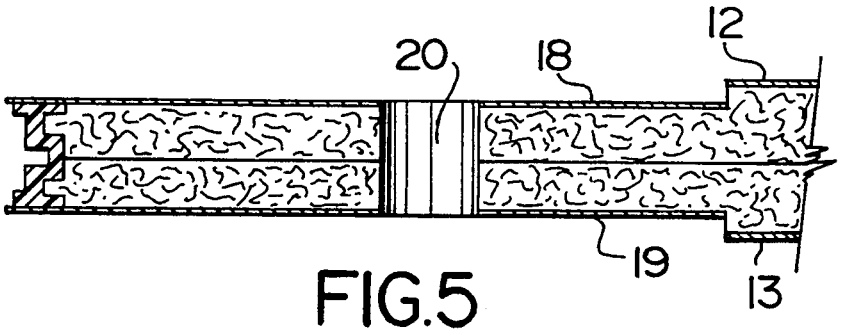
FIG. 5 is a part sectional view taken along line 5—5 of FIG. 2.

Each panel section has selected right angular corners thereof that are recessed in at least the top surface and preferably both the top and bottom surfaces as indicated respectively at 18 and 19 in FIG. 5. These recesses are of right angle isosceles triangular configuration in plan view as clearly seen from FIGS. 2, 3 and 3A. The recesses are at selected right angle corners of the panels and it is these right angular corners under which the legs are located to support the table top.

Referring to FIG. 2 there is illustrated in top plan view a single panel A in which the top surface has two corner recesses 18. A single panel C is illustrated in top plan view in FIG. 3 and it has one recess 18 in the top surface thereof. A single panel B is illustrated in top plan view in FIG. 3A and three of the five corners have recesses 18 in the top surface thereof. Disposed centrally of each recess 18 is a hole 20 that extends through the panel for receiving a fastener.

The panels A, C and B of FIGS. 2, 3 and 3A are used as indicated in the assembly in FIG. 1 and while not shown in the drawings each is also provided with a recess 19 in the bottom face.

A connector plate of appropriate size and shape fits into the triangular recess in a corner of the panel section (or adjoining recesses of abutting panels) and attaches to a rod (or tube) that extends through the leg. Three different connector plates designated respectively 21, 22 and 23 are illustrated in FIG. 6, plates 21 and 22 being triangular with one twice the size of the other and connector plate 23 being square. The surface area of plate 21 corresponds to the surface area of a single recess 18 and plate 23 is four times that size.

In the table arrangement illustrated in FIG. 1 a square connector plate 23 fits into the triangular recess in each of the two abutting panel sections A and into recesses in each of the two abutting panels sections C. Panel sections C abut the ends of the two panel sections A. The plate overlaps the table top panel sections and is attached to the leg L1, clamping the two panel sections C therebetween providing thereby a rigid connection. A plate 22 fits into recesses 19 on the underface of the two panels A (see FIGS. 9 and 10). Plates 22 and 23 are fastened together by bolts 24 that thread into a sleeve 25 in the panel aperture 20.

The legs are right triangular and each leg is one or two leg units with each leg unit having two right triangular rigid sections joined together. The leg L1 is shown in detail in FIG. 7 and consists of four joined together extruded metal sections 30 each of which is right triangular in cross-section. A band of material in the form of a sleeve 31 circumscribes the bottom end of the leg and conceals a levelling glide within. The leg sections are joined together by a plurality of clips and two joined together sections is considered as one leg unit with such leg having a cross-sectional outer configuration and size corresponding to that of a single recess 18. This is perhaps more clearly apparent from FIG. 11 which illustrates leg L3 detached from a corner of the panel B. The leg L3 has two joined together rigid extruded sections 30 and attaches to the panel by a tubular member 26 that extends through the leg, a plate 21 that fits into recess 18 and a bolt 24A that threads into tubular member 26. Member 26 can be a rod rather than a tube in which case the end is threaded and threads into a sleeve 25 in the panel aperture 20.

The tube 26 is fastened to the bottom end of the leg (see FIG. 8) by a lock nut 27. Threaded into the bottom end of the tube 26 is a threaded rod 28 having a foot member 29 on the bottom end thereof forming a levelling glide.

From the foregoing described leg arrangements and the drawings it is apparent there is one leg connecting rod 26 for each pair of joined together leg sections. Leg L1 has two such rods, i.e., one for each of the two bolts 24A illustrated in FIG. 1. The other two bolts 24 shown in FIG. 1 are each as illustrated in FIG. 10.

FIG. 12 illustrates, by way of example, means for mounting accessories on the table. Referring to FIG. 12 there is illustrated a portion of panel K and one of its supporting legs L5 which consists of two joined together leg sections 30 as illustrated in FIG. 11. The construction of FIG. 11 is applicable to FIG. 12 with the leg tube 26 being threaded into an insert fit into the bore 20 of the panel. A plate 21 fits into the recess of the panel and a post 50, anchored to the tube 26, extends upwardly from the plate. There may be a single post 50 or a series of posts 50 stacked one on top of the other in end-to--end relation as illustrated in FIG. 12. FIG. 13 illustrates, in exploded view, a preferred construction of each post 50. Brackets 51 secured to and projecting from the posts provide means for mounting an accessory 52 on the table.

The accessory 52 is shown as a metal grill but it could be a solid plate or panel providing an acoustic and/or visual barrier. Mail and/or supply trays and/or baskets can be part of the panel and projecting therefrom toward the work surface or separately attached thereto or mounted on the post. The barriers may be cantilevered from a post or a series of posts extending upwardly from one of the legs or instead of being cantilevered the other end may be attached to a similar stacked series of posts 50 secured to another leg or plate as shown in FIG. 12 which joins one panel section to another. The panels which attach to the posts may be for functional and/or aesthetic purposes.

As previously indicated a preferred construction of each post 50 is illustrated in exploded view in FIG. 13. Referring to this Figure there is a short rod or tube 53 threaded internally and externally at respective opposite ends A and B. The externally threaded end B threads into sleeve 25 (see FIG. 11) forming an extension in the leg tube 26. The sleeve 54 fits over the rod 53 and at the bottom end bears against the plate 21. The bracket member 51 fits between a pair of spacers 55, the bottom one of which fits partially into the sleeve 54 and partially bears against the upper end of such sleeve. A cap 56 fits onto the top spacer and bolt 24A threads into the internally threaded end A of rod 53. Additional sleeves, spacers and cantilever arms (or a filler substitute for the arm) may be used as required to satisfy the desired height requirement. The rod or tube 53 corresponds to the desired height of the post or series of posts stacked one on top of the other. In place of the cantilevered bracket or arm 51 an O-ring filler may be used between the pair of spacers 55.

As an alternative to foregoing construction each post 50 may have a threaded spigot (not shown) on a lower end which threads into the member 25 on the upper end of the leg and have an internal thread on the opposite upper end for receiving a cap or further post to be stacked thereupon. An O-ring filler or bracket 51 may be clamped between two posts stacked one on top of the other.

The embodiments of the invention if which an exclusive property or privilege is claimed are defined as follows:

1. A table assembly comprising:

(a) a plurality of support legs;

(b) at least two right angular panel sections each having at least three corners, planar upper and lower main panel faces and panel edge sidewalls the latter of which intersect at 45°, 90° or 135° corners;

(c) recesses in at least said upper faces which extend inwardly from selected ones of said 90° corners, each recess being in the shape of a right angle isosceles triangle; and (d) means to join said panel sections together with selected sidewalls thereof in abutting relation and the upper panel faces aligned so as to provide a continuous table top surface extending from one said panel section to the other, said joining means comprising a flat connector plate in each of the recesses and adjacent adjoining recesses in the upper faces of said abutting panel sections, each said connector plate corresponding in shape to the recess associated therewith and overlapping abutting panels having adjoining recesses and bolt means connecting the support legs to a respective one of said connector plates associated therewith and clamping the panels associated therewith therebetween.

2. A table assembly comprising:

(a) a plurality of support legs;

(b) at least two right angular panel sections each having at least three corners, planar upper and lower main panel faces and panel edge sidewalls the latter of which intersect at 45°, 90° or 135° corners;

(c) recesses in at least said upper faces which extends inwardly from selected ones of said 90° corners, each recess being in the shape of a right angle isosceles triangle; and (d) means to join said panel sections together with selected sidewalls thereof in abutting relation and the upper panel faces aligned so as to provide a continuous table top surface extending from one said panel section to the other, said joining means comprising a flat connector plate in each of the recesses and adjacent adjoining recesses in the upper faces of said abutting panel sections, each said connector plate corresponding in shape to the recess associated therewith and overlapping abutting panels having adjoining recesses and bolt means connecting the support legs to a respective one of said connector plates associated therewith and clamping the panels associated therewith therebetween and wherein each said leg support comprises at least two side by side tubular rigid sections each, in cross section, being right triangular and the two together in cross-section corresponding in size to the surface area of a single recess in a face of the panel.

3. A table assembly as defined in claim 2 including a first channel in at least selected edges of said panel sections, connecting strips in said channels and located so as to bridge adjacent panel sections and means connecting said strips to said panel sections and decorative strip means in said channels obscuring from view exposed ones of said bridging strips.

4. A table assembly comprising:

(a) a plurality of support legs;

(b) at least two right angular panel sections each having at least three corners, planar upper and lower main panel faces and panel edge sidewalls the latter of which intersect at 45°, 90° or 135° corners;

(c) recesses in at least said upper faces which extend inwardly from selected ones of said 90 °corners, each recess being in the shape of a right angle isosceles triangle; and (d) means to join said panel sections together with selected sidewalls thereof in abutting relation and the upper panel faces aligned so as to provide a continuous table top surface extending from one said panel section to the other, said joining means comprising a flat connector plate in each of the recesses and adjacent adjoining recesses in the upper faces of said abutting panel sections, each said connector plate corresponding in shape to the recess associated therewith and overlapping abutting panels having adjoining recesses and blot means connecting the support legs to a respective one of said connector plates associated therewith and clamping the panels associated therewith therebetween and including a recess in said lower panel faces at selected corners of the panel sections, said recesses in said upper and lower faces being aligned in overlying relation relative to one another.

5. The table assembly as claimed in claim 2, wherein an aperture extends through the panel at a position centrally of each recess therein and wherein said connector plates include apertures extending therethrough alignable with an aperture in the panel when fitted into the recess therein.

6. The table assembly as claimed in claim 5, wherein the surface of each said connector plate is in the shape of a right angle triangle and has a single aperture centrally thereof, said plate having a surface area corresponding to that of a single recess in the face of the panel.

7. The table assembly as claimed in claim 5, wherein the surface of each said connector plate is in the shape of a right angle triangle and has two spaced apart apertures extending therethrough and wherein the surface area is twice that of a single recess in the panels.

8. The table assembly as claimed in claim 5, wherein said connector plates are square having four times the surface area of each said panel recess.

9. A table assembly as defined in claim 4 including a rigid strip of material extending along each edge of each of said panel sections, said strips of material each having a first channel in an edge face thereof and a second channel, narrower in width than said first channel and in the base thereof.

10. A table assembly comprising:

(a) two or more panel sections disposed in edge to edge abutting relation proving a table top work surface that extends from one panel section to the other, each said panel section being right angular and having at least three corners each selected from an angle of 45°, 90°, and 135°, an upper face, a lower face and outer edge walls;

(b) a plurality of vertically disposed legs supporting said panel sections and disposed under selected ones of the right angular corners of the panel sections;

(c) means connecting said legs to said panel sections to support the panels and including means joining said panels together in edge to edge relation comprising:

(i) recesses in the upper face and located at said selected right angular corners of the respective panel sections, each said recess being in the shape of a right angle isosceles triangle of selected size;

(ii) a connector plate in a respective one of each said recesses and corresponding in size and shape to that of the recess or adjoining recesses associated therewith; and (iii) bolt means connecting a respective one of said plates to a respective one of said legs and clamping the panel sections associated therewith therebetween adjacent ones of said adjoining recesses at said selected adjoining corners of said panels being of right angle isosceles triangular shape with a connector plate of corresponding shape and size fitting there into joining said panels together in alignment with one another.

11. A table assembly comprising:

(a) two or more panel sections each of which is right angular and having an upper planar surface, a lower planar surface, and at least three corners each selected from an angle of 45°, 90° and 135°;

(b) a plurality of support legs; and (c) means connecting said legs to said panels to support the panels and including means joining said panels together in edge to edge relation; said connecting means including:

(i) a recess in an upper face of the panel and extending inwardly from a selected 90° corner thereof, said recess being in the shape of a right angle isosceles triangle;

(ii) a connector plate, having the same shape as said recess or group of adjacently disposed recesses; and (iii) bolt means connecting said plate to a leg and clamping each panel section associated therewith therebetween, selected ones of said connector plates having a surface area that is two, three or four times that of each said recess and fitting into as many of the same as are disposed adjacent one another and thereby overlapping abutting panels.

12. A table assembly as defined in claim 11 wherein each leg comprises two, or a multiple of two rigid right triangular sections disposed side-by-side and each extending the length of the leg.

13. A table assembly as defined in claim 12 wherein each said leg section is a metal extrusion.

14. A table assembly as defined in claim 12 wherein each said leg section is a plastics material extrusion.

15. A table assembly as defined in claim 11 wherein at least selected edges of each of said panel sections have a channel therein extending longitudinally along the edge for receiving therein panel connecting strips.

16. A table assembly as defined in claim 15 wherein said channel is located in a separate elongate member and wherein such elongate member is securely attached to the panel.

17. A table assembly as defined in claim 16 wherein said separate elongate member is at least one of wood, metal and plastics material.

18. A table assembly as defined in claim 11 wherein each edge of each panel section has an extruded rigid strip extending longitudinally therealong and wherein each strip has a first channel along an outer face thereof for receiving a connecting strip and a second channel in the bottom of said first channel for receiving connecting strip anchor means.

19. A table assembly as defined in claim 18 including shoulder means, extending along outer opposite edges of said first channel, providing abutting means for a decorative concealing strip.

20. A table assembly as defined in claim 11 wherein selected ones of said bolt means has a post attached thereto that projects upwardly from the upper panel surface and provides means for mounting accessories thereon.

21. A table assembly as defined in claim 20, wherein selected ones of said upwardly projecting posts have at least one arm attached thereto and cantilevered therefrom, said cantilevered arms providing said means for mounting the accessories.

22. A table assembly as defined in claim 21, wherein each said post is a series of post elements in end to end relation and having said arms clampingly engaged between selected ones thereof.

23. A table assembly comprising:

(a) a plurality of support legs;

(b) at least two right angular panel sections each having at least three corners, planar upper and lower main panel faces and panel edge sidewalls the latter of which intersect at 45°, 90° or 135° corners;

(c) recesses in at least said upper faces which extend inwardly from selected ones of said 90 °corners, each recess being in the shape of a right angle isosceles triangle; and (d) means to join said panel sections together with selected sidewalls thereof in abutting relation and the upper panel faces aligned so as to provide a continuous table top surface extending from one said panel section to the other, said joining means comprising a flat connector plate in each of the recesses and adjacent adjoining recesses in the upper faces of said abutting panel sections, each said connector plate corresponding in shape to the recess associated therewith and overlapping abutting panels having adjoining recesses and bolt means connecting the support legs to a respective one f said connector plates associated therewith and clamping the panels associated therewith therebetween and including a first channel in at least selected edges of said panel sections, connecting strips in said channels and located so as to bridge adjacent panel sections and means connecting said strips to said panel sections.

24. A table assembly comprising:

(a) at least two panel sections disposed in edge to edge abutting relation providing a table top work surface extending from one panel section to the other, each said panel section being right angular and having at least three corners, an upper face, a lower face and outer edge walls;

(b) a plurality of vertically disposed legs supporting said panel sections and disposed under selected ones of the right angular corners of the panel sections;

(c) means connecting said legs to said panel sections comprising:

(i) recesses of selected shape at selected corners of the respective panel sections;

(ii) a plate in a respective one of each said recesses and corresponding to the outline shapes thereof; and (iii) means connecting a respective one of said plates to a respective one of said legs and clamping the panel sections associated therewith therebetween; and (d) means joining said two panel sections together comprising adjacently disposed pairs of selected ones of said recesses at selected adjoining corners of said panels and a plate twice said recess selected size, said plate fitting into an adjoining pair of recesses in the adjoining panels and means anchoring said plate securely to retain said panels in alignment with one another and including a rigid strip of material extending along each edge of said panel sections, said strips of material each having a first channel in an edge face thereof and a second channel, narrower in width of said first channel and in the base thereof and wherein said rigid strip of material is an extruded metal or plastics material section.

* * * * *